United States Patent [19]

Tate

[11] Patent Number: 4,790,575

[45] Date of Patent: Dec. 13, 1988

[54] KNOTTING DEVICE

[76] Inventor: John L. Tate, 36341 Caraway Rd., Denham Springs, La. 70726

[21] Appl. No.: 115,345

[22] Filed: Nov. 2, 1987

[51] Int. Cl.[4] ..... D03J 3/00
[52] U.S. Cl. ..... 289/17
[58] Field of Search ..... 289/17

[56] References Cited

U.S. PATENT DOCUMENTS 4,525,003 6/1985 Tate ..... 289/17

*Primary Examiner*—Louis K. Rimrodt

*Attorney, Agent, or Firm*—James M. Pelton; Edgar E. Spielman, Jr.

[57] ABSTRACT

This invention relates to a knotting device which comprises a handle portion which carries an elongated member and an elongated needle member. The elongated member and the elongated needle member are associated with one another by a linking member so that they can move from a first position to a second position. The elongated needle member is used to initially engage the knot and obtain an initial tightening thereof. The elongated member is used to finally tighten the knot after the elongated needle member has been removed from the knot as the elongated member moves to the second position.

9 Claims, 3 Drawing Sheets

KNOTTING DEVICE

BACKGROUND OF THE INVENTION

The manufacture of articles such as necklaces, bracelets, belts, etc., by stringing beads onto a length of twine is probably as old as civilization. In its simplest form, such manufacture only requires the placement of a hole through each bead and the stringing of the beads onto twine of a selected length. A clasp at or the simple knotting of the terminal ends of the twine is used to connect the twine ends to one another to complete the article.

Generally, the twine utilized is of small diameter so that its presence in the article is hidden or is at least not prominent—the real prominence being reserved to show off the beads. The use of small diameter twine, while aesthetically desirable, is not without functional limitation since the smaller the twine diameter the less its breaking strength. Thus, consideration has to be given to the strength of the twine so that is will not be easily broken under expected stress when worn by the wearer. The compromise between twine diameter and twine strength, however, is easily resolved in the direction most important to the manufacturer. Even with the desired compromise being made, twine breakage has and still occurs. If the beads are merely strung onto the twine without further precaution, twine breakage results in all the beads falling from the string and being damaged or lost. If the beads are of material of little value, such as plastic or glass, damage to or loss of the beads is tolerable. However, should the beads be of a semi-precious stone, pearl or the like, damage and loss is not tolerable and precaution against such an occurrence has to be provided for.

It is well known that such precaution can be obtained by the simple expedient of knotting the twine before and after each bead. In this manner, twine breakage will only occasion the loss or damage of a single bead. The knot size is, of course, larger than the diameter of the hole in the bead. To simplify the assembly of a knotted string of beads, the bead hole diameter is caused to be rather constant. Still, however, the knotting technique is time consuming and expensive—this being especially true when the knotting is done by hand. Hand knotting requires concentration to details such as uniformity in knot size and knot placement. Achieving uniformity in knot size is made somewhat difficult due to oils in the knotter's hands being transferred to the twine as the knot is pushed tight by the knotter's thumb nail and forefinger. The transferred oils changes the twine's knot slipping characteristics thereby introducing variability in the tension on the twine needed to slip and form the final knot.

To provide speed and fidelity of knot formation in twine, it is an object of this invention to provide a knotting device which quickly slips and forms a knot with minimization of hand contact with the twine.

THE INVENTION

This invention relates to a knotting device for slipping and finally tightening a loosely tied knot. The device comprises a handle having an interiorally located cavity. The handle is configured to comfortably rest in the human hand. The handle portion can be of any suitable material, for example, wood, plastic, metal, etc. For a point of reference, the cavity will be said to be located at the forward end of the handle. The handle is most conveniently constructed by coupling two handle halves, one to the other, by screw, rivet, gluing, etc. Each of the handle halves will have cut therein half cavities which, when brought together with the assembly of the two handle halves, will define the above mentioned cavity. Pivotally mounted at the forward end of the handle is an elongated member. The elongated member should be fairly rigid and is preferably made from metal or an engineering thermoplastic. The pivotal mounting of the elongated member will allow for it to move between a first position and a second position. Further, the elongated member, in its pivotal mount, will have a first portion which is in the handle cavity and a second portion which is out of the cavity. The second portion has a knot-engaging recess associated therewith.

An elongated needle member is also provided which has a first portion located in the handle cavity and a second portion outside of this cavity. The second portion of the elongated needle member terminates in at least substantially a point. The elongated needle member is preferably of a resilient flexible material such as stainless steel or a suitable engineering thermoplastic. The elongated needle member is movable between a first position and a second position. When in the first position, the terminal pointed end of the second portion is at a location which is further from the forward end of the handle than will be the point's location when the elongated needle member is in the second position. Thus, the elongated needle member, in moving from the first position to the second position, moves further into the handle cavity.

At least partially located within the handle cavity is a linking member which is associated with the first portion of the elongated member and with the first portion of the elongated needle member. This double association allows for the linking member to function to move the elongated needle member from its first position to its second position when the elongated member moves from its first position to its second position.

In operation, the knotting device of this invention is the paragon of simplicity. When tightening an overhand knot, for example, the end of the elongated needle member is passed into the major loop portion of the knot. The free tail of the knot is then pulled to initially tighten the knot onto the elongated needle member. As the tightening force is increased, the knot is brought to nest within the knot engaging cavity which is associated with the elongated member. Continued application of a pulling force therefor will act upon the pivoted elongated member so that it is moved from its first position to its second position. As this movement of the elongated member is occurring, the linking member functions to retract the elongated needle member so that its pointed end is moved toward the forward end of the handle and outside of the knot. With the elongated needle member removed from the knot, continued application of the pulling force on the free tail of the knot will cause the knot to be finally tightened while engaged with the knot-engaging recess. After the knot has been tightened to the user's specification, the knot is removed from the knot-engaging recess.

It is preferred that the elongated member have not one but two knot-engaging recesses, with one cavity being on one side of the second portion of the elongated member and the other knot-engaging cavity being opposite the other and on the other side of the second portion of the elongated member. By having two such knot recesses, the knotting device of this invention is conveniently utilized by either right- or lefthanded operators. It is also preferred that the knot-engaging recess be V-shaped which opens towards the forward end of the handle. The V shape provides a configuration which conveniently can engage the free tail of the knot and achieve the nesting of the knot in the bottom portion of the V. Additional configurations are suitable for the knot recess(es). See the forked portions described in U.S. Pat. No. 4,525,003.

Since simplicity in construction is often required to produce an economical device, it is preferred that the linking member be configured as a pivoted lever member. One of the lever member ends will be associated with the first portion of the elongated member while the other of the lever ends will be associated with the first portion of the elongated needle member. To promote simplicity in operation, it is preferred that there additionally be provided a return mechanism which will return both the elongated member and the elongated needle member from their respective second positions to their respective first positions. This return means can be most simply and conveniently a spring which is associated with the linking mechanism.

These and other features of this invention contributing to satisfaction in use and economy in manufacture will be more fully understood from the following description of the accompanying drawings in which.

Figure 1:
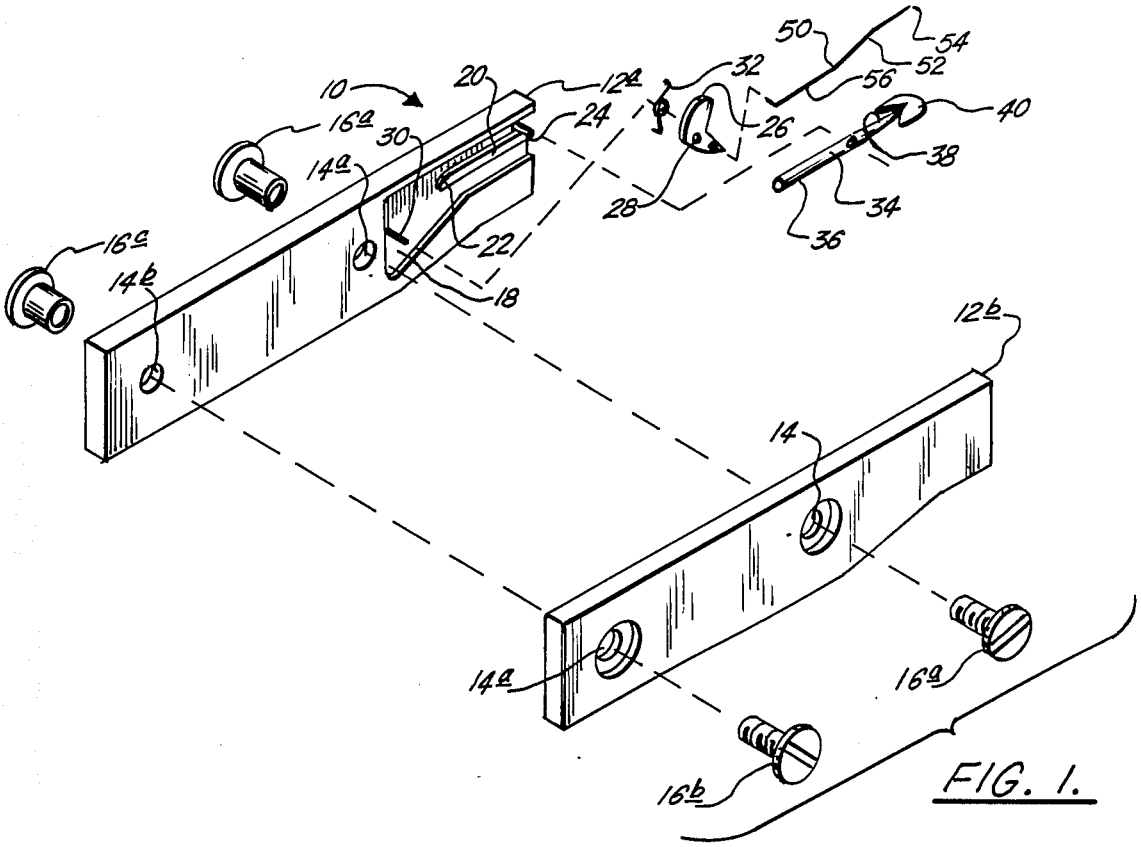
FIG. 1 is an exploded view of a knotting device of this invention.
Figure 9:
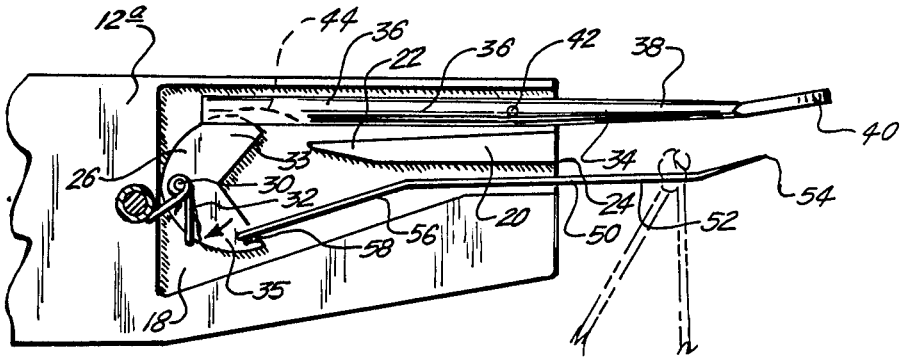
FIG. 9 is a cut-away, partial side view showing the device in FIG. 1 with the elongated member and the elongated needle member in their respective first positions.
Figure 9A:
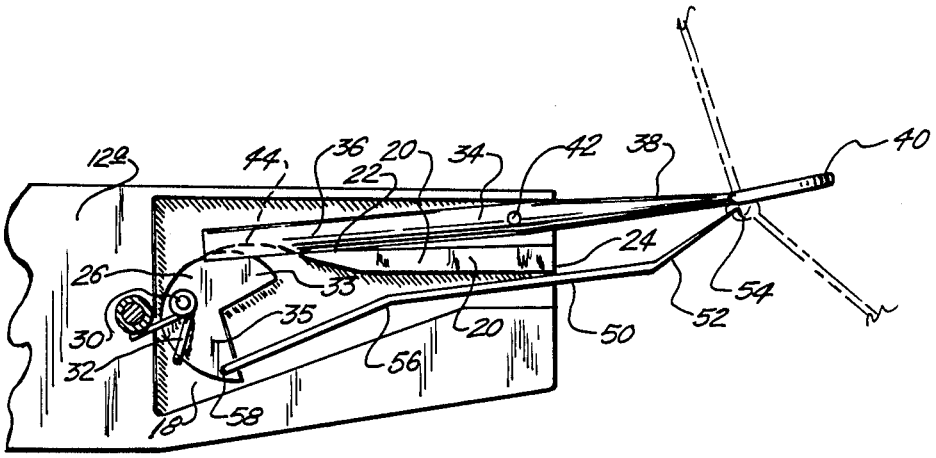
FIG. 9*a* is a cut-away, partial view of the device shown in FIG. 1 showing the elongated member and the elongated needle members in their respective second positions.

Referring now to FIGS. 1–3 and 9 and 9*a*, there can be seen a knotting device of this invention generally designated by the numeral 10. Knotting device 10 has a handle 12 (FIG. 2) which is comprised of handle halves 12*a* and 12*b* (FIG. 1). Handle halves 12*a* and 12*b* are coupled together by means of screws 16 and 16*b* and nuts 16*a* and 16*c*. Screw 16 nests within apertures 14 and 14*c* while screw 16*b* nests within apertures 14*a* and 14*b*. As can be seen in FIGS. 1, 9 and 9*a*, handle halve 12*a* has a half cavity 18 at its forward end. Handle half 12*b* has a like mirror-image cavity at its forward end though it is not shown in the drawings. When the half cavities in handle halves 12*a* and 12*b* are brought together, they form a single cavity in handle 12. In cavity 18 and its counterpart in handle half 12*b*, there is located boss 20 which has a forward lower end 24 and a rearward upper end 22. The function of boss 20 will be hereinafter described.

Figure 2:
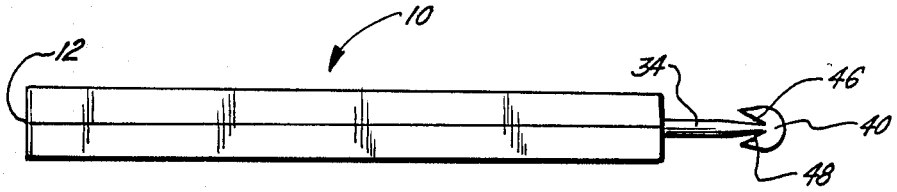
FIG. 2 is a top plan view of the device shown in FIG. 1.
Figure 3:
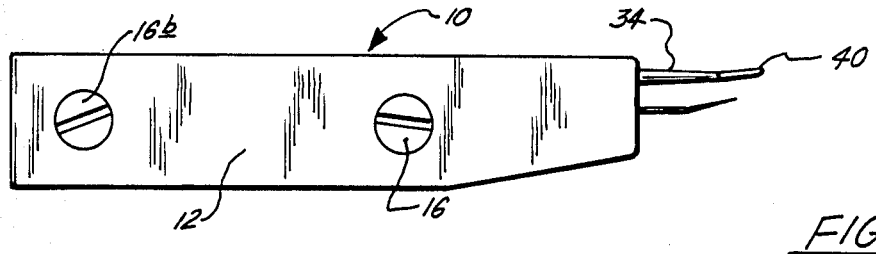
FIG. 3 is a side elevational view of the device shown in FIG. 1.

Knotting device 10 also includes elongated member 34 which is pivotally mounted to handle 12 by means of pivot pin 42. As can be seen in FIGS. 9 and 9*a*, elongated member 34 has a first portion 36 located within the handle cavity. Outside of the handle cavity is second portion 38 of elongated member 34. At terminal end 40 of second portion 38 of elongated member 34 are two V-shaped knot-engaging recesses 46 and 48, as is shown in FIG. 2. A longitudinal groove 44 is located at the terminal end of first portion 36 of elongated member 34 and is shown in phantom line in FIGS. 9 and 9*a*. As mentioned previously, the elongated member is preferably of a material which is rigid against significant flexing under the forces which will normally be applied to elongated member 34 as hereinafter described.

Knotting device 10 also has an elongated needle member 50 which has a first portion 56 within cavity 18 and a second portion 52 which is outside of cavity 18. Second portion 52 terminates into a pointed end 54. Elongated needle member 50 is preferably of a resiliently flexible material so that it is capable of some deflection upon the application of a pulling force to achieve initial tightening of the knot all as hereinafter described.

Within the handle cavity, there is additionally located a link, to link together for movement, elongated member 34 and elongated needle member 50. Lever member 26 is pivotally mounted by way of pivot pin 30. Lever member 26 has one of its ends 33 slidably located within groove 44 of elongated member 34. Connected to the other of the ends 35 of lever member 26 is the terminal end 58 of first portion 56 of elongated needle member 50. Biasing lever member 26 to the position shown in FIG. 9 is spring 32.

Figure 4:
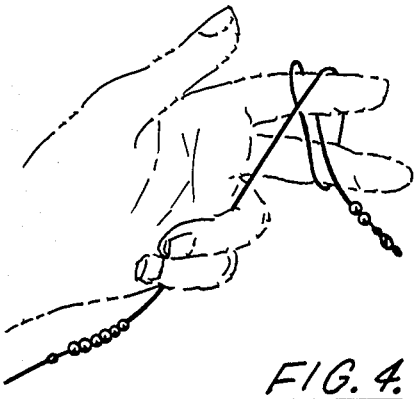
FIGS. 4–8 show the device shown in FIG. 1 in use.
Figure 5:
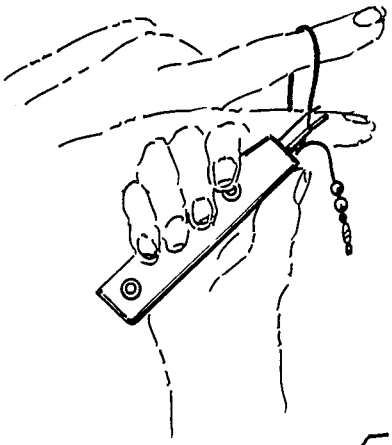
Figure 6:
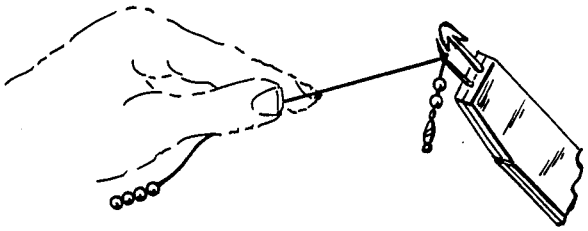
Figure 7:
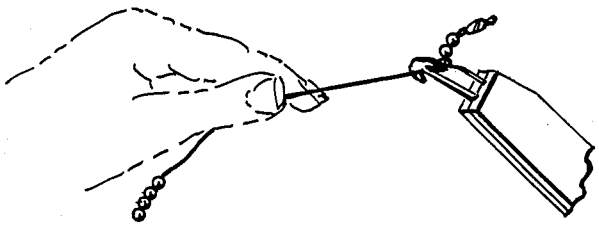
Figure 8:
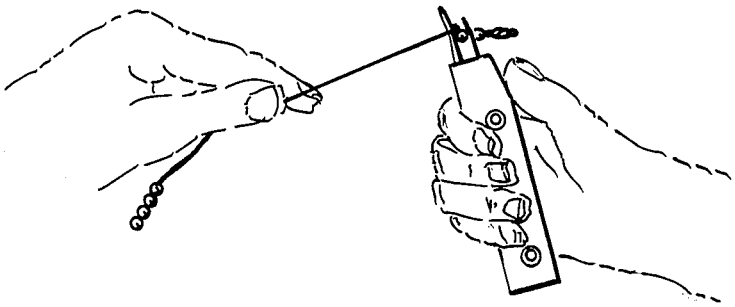

In use, knotting device 10 is uncomplicated. FIGS. 4–8 illustrate how knotting device 10 is used with an overhand knot. In FIG. 4, a simple overhand knot is loosely formed with the index finger and the forefinger. In FIG. 5, elongated needle member 50 is inserted into the major loop of the overhand knot. Knotting device 10, which is held in the hand not used to originally form the overhand knot, is pulled away from the free tail of the overhand knot, as is shown in FIG. 6. Initial tightening of the overhand knot is accomplished thereby. In FIG. 7, it can be seen that the free tail of the knot is brought into the knot-engaging recess by causing the free tail to enter the open end of the V. Device 10 is turned so that the free tail of the overhand knot is pulling elongated needle member 50 towards elongated member 34 as seen in FIG. 7. Continued pulling on the free tail of the overhand knot will result in elongated needle member 50 making contact with lower end 24 of boss 20. Once this contact is made, further free movement in that direction of elongated needle member 50 is prevented and further pulling of the free tail of the overhand knot will cause the second portion 52 of elongated needle member 50 to flex towards terminal end 40 of elongated member 34 until the knot nests in one of the knot-engaging recesses. As the knot is further tightened, elongated needle member 50 will further flex and elongated member 34 will pivot about pivot pin 42 causing the application of a force on lever member 46 causing it to pivot about pivot pin 30. This pivoting motion causes elongated needle member 50 to move towards the forward end of handle 12 and to thereby extract elongated needle member 50 from the overhand knot. The pivoting motion of elongated member 34 is restricted by upper end 22 of boss 20. Such restriction is desirable as it provides, when elongated member 34 is in this position, a rigid structure against which the knot can be finally tightened. With elongated needle member 50 extracted from the knot, the knot is finally tightened by the application of sufficient force to reduce the knot to the size desired. After the knot has been finally tightened, the free tail of the overhand knot is removed from the knot-engaging recess thereby de-nesting the tightened knot. With no force being applied to elongated member 34, spring 32 acts on lever member 26 so as to return lever member 26 and the associated elongated member 34 and elongated needle member 50 to their respective first positions as is shown in FIG. 9.

While the embodiment shown in the drawings is a preferred embodiment, it is to be understood that there are other possible variations which would still use the principles of this invention. For example, boss 20 could be eliminated and merely replaced by a pin which would act to limit the pivotal motion of elongated member 34 as it reaches its second position. Without boss 20, elongated needle member 50 would not be stopped in its movement towards the knot-engaging cavities, but would rather be allowed to move thereto quite freely. Thus, the knot reaching the knot-engaging recesses would not be as tight as would be the case for the embodiment shown in the drawings. For the embodiment shown in the drawings, the stopping of the travel of elongated needle member 50 allows for the application of a force against the resiliency of elongated needle member 50 which results in an initially tighter knot. Without boss 20, it would not be particularly important to have elongated needle member 50 made of a resilient material as elongated needle member 50 would not be stopped and caused to flex against the initial tightening forces.

I claim:

1. A knotting device which comprises:

(a) a handle having an internally located cavity;

(b) an elongated member pivotally mounted to said handle whereby said elongated member is movable between a first position and a second position and said elongated member having a first portion which is in said cavity and a second portion which is out of said cavity, said second portion having a knot-engaging recess associated therewith;

(c) an elongated needle member having a first portion in said cavity and a second portion out of said cavity, said second portion terminating in at least substantially a point, said elongated needle member being movable between a first position and a second position, said second position locating said point closer to said handle than when said elongated needle member is in said first position; and (d) a linking member at least partially located in said cavity, said linking member being associated with said first portion of said elongated member and with said first portion of said elongated needle member whereby movement of said elongated member from said first position to said second position will cause said point to move towards said handle and away from said knot recess.

2. The knotting device of claim 1 wherein said second portion of said elongated member has two knot-engaging recesses associated therewith, one knot-engaging recess being on one side of said second portion and the other knot-engaging recess being opposite the other end and on the other side of said second portion.

3. The knotting device of claim 2 wherein each of said knot-engaging recesses are V-shaped and open towards said handle.

4. The knotting device of claim 1 wherein said knot-engaging recess is V-shaped and opens towards said handle.

5. The knotting device of claim 1 wherein said linking member is a pivoted lever member.

6. The knotting device of claim 5 wherein said pivoted lever member, at one of its ends, is in sliding engagement with said first portion of said elongated member and is, at the other of its ends, in attached relationship with said first portion of said elongated needle member.

7. The knotting device of claim 1 wherein there is additionally provided a return means within said cavity to return said elongated member and said elongated needle member from their respective said second positions to their said first positions.

8. The knotting device of claim 7 wherein said return means is a spring associated with said linking means.

9. A knotting device for slipping and finally tightening an overhand knot from a loosely tied overhand knot, said device comprising:

(a) a handle having an internally located cavity;

(b) an elongated needle member carried by said handle and partially within said cavity, said elongated needle member being used to extend into the major open loop of said loosely tied overhead knot whereby said loosely tied knot can be initially tightened by the application of a pulling force on the free tail of the overhand knot;

(c) an elongated member; (i) associated with said handle, (ii) being partially located within said cavity, (iii) being movable from a first position to a second position and (iv) having a knot recess, whereby said initially tightened knot is received in said knot recess and the continued application of said pulling force causes said elongated member to move from said first position to said second position;

(d) linking means associated with both said elongated member and said elongated needle member whereby the movement of said elongated member from said first position to said second position causes said elongated needle member to be retracted from said initially tightened knot so that said initially tightened knot can be finally tightened while engaged with said knot recess.

* * * * *